US007233113B2

(12) United States Patent
Ongaro et al.

(10) Patent No.: US 7,233,113 B2
(45) Date of Patent: Jun. 19, 2007

(54) POWER SUPPLY SYSTEM FOR LIQUID CRYSTAL MONITORS

(75) Inventors: Andrea Ongaro, Vicenza (IT); Giorgio Spiazzi, Verona (IT); Simone Buso, Padua (IT); Paolo Tomasin, Padua (IT)

(73) Assignee: Global Display Solutions S.p.A., Vicenza (IT)

( * ) Notice: Subject to any disclaimer, the term of this patent is extended or adjusted under 35 U.S.C. 154(b) by 107 days.

(21) Appl. No.: 10/913,141

(22) Filed: Aug. 6, 2004

(65) Prior Publication Data

US 2005/0062433 A1 Mar. 24, 2005

(30) Foreign Application Priority Data

Aug. 11, 2003 (IT) ..... VI2003A0165

(51) Int. Cl.
*H05B 37/00* (2006.01)

(52) U.S. Cl. ..... 315/219; 315/224; 315/279

(58) Field of Classification Search ..... 315/219, 315/224, 279
See application file for complete search history.

(56) References Cited

U.S. PATENT DOCUMENTS

| | | | | |
|---|---|---|---|---|
| 3,707,636 | A | 12/1972 | Inoue | |
| 6,111,765 | A * | 8/2000 | Ganser et al. | 363/55 |
| 2002/0036608 | A1* | 3/2002 | Hirataka et al. | 345/87 |
| 2003/0001514 | A1 | 1/2003 | Kim et al. | |
| 2003/0015943 | A1 | 1/2003 | Kim et al. | |
| 2003/0222537 | A1* | 12/2003 | Chou | 310/318 |
| 2003/0234762 | A1 | 12/2003 | Nakatsuka et al. | |
| 2005/0035719 | A1* | 2/2005 | Dellian et al. | 315/244 |
| 2005/0116662 | A1* | 6/2005 | Sanchez | 315/225 |

FOREIGN PATENT DOCUMENTS

| | | |
|---|---|---|
| JP | 2000-058287 | 2/2000 |
| JP | 2001-085759 | 3/2001 |

OTHER PUBLICATIONS

EPO Search Report.
Jeong H-S et al: "Parallel Driving of Piezoelectric Transformer" Japanese Journal Of Applied Physics, Publication Office Japanese Journal Of Applied Physics, Tokyo, JP, vol. 38, No. 9A, Part 1, Sep. 1999, pp. 5166-5169.

* cited by examiner

*Primary Examiner*—David Vu
(74) *Attorney, Agent, or Firm*—Hedman & Costigan; James V. Costigan

(57) ABSTRACT

A power supply system for liquid crystal monitors includes a first DC/AC converter (FBS, HBS) operating at predetermined frequency and duty-cycles and being fed by a second DC/DC converter (FC) which regulates the circuit voltage. The feeding system can feed all the fluorescent lamps (L, L1, LN) in the monitor through a bus connection which transmits the output sinusoidal voltage (SG1, SG2, SG3) from the first DC/AC converter (FBS, HBS) to the primary windings of a plurality of parallel connected piezoelectric transformers (PT, PT1, PT2, PTN, PT2N) which are connected with the fluorescent lamps (L, L1, LN).

7 Claims, 3 Drawing Sheets

POWER SUPPLY SYSTEM FOR LIQUID CRYSTAL MONITORS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention refers to a power supply system for liquid crystal monitors.

The more and more widespread use of liquid crystal (LCD) screens (monitors) in many applications, e.g. Personal Computers (PCs), measure instruments, bank counter terminals (Bancomat), information terminals in stations, airports, TVs, has rapidly caused the need to display alphanumeric characters and images extremely clearly with any kind of light (either natural or artificial) and, consequently, to generate adequate high intensity light.

(2) Description of Related Art

At present, the use of cold cathode fluorescent lamps (CCFLs) and/or EEFL lamps is the most widely used solution for such applications.

However, the power supply systems conventionally used for such applications utilize resonant converters which are magnetically coupled with each fluorescent lamp by means of conventional transformers or central tap transformers and these technical solutions require high voltage capacitive elements (ballast circuits) to be series connected with each lamp.

BRIEF SUMMARY OF THE INVENTION

The aim thereof is to compensate the lamp equivalent negative impedance and to avoid the potential drop created from the lamp striking to the operation static condition of said lamp, once it has been lit.

Moreover, in such applications it is normally necessary to use one inverter for each lamp (at least with CCFL lamps).

From the above it is clearly understandable that large monitors with high lighting power (such as those used with full atmospheric light) need an extremely large number of converters (such screens may need up to 15 or 20 converters), thus increasing the circuit complexity, the monitor overall dimensions, as well as production and operation costs and extremely compromising the general reliability of the system.

Therefore, an object of the present invention is to provide a power supply system for liquid crystal monitors which, in general, obviates the above mentioned drawbacks and, in particular, reduces the components and the complexity of conventional power supply systems, particularly when they are used for large monitors with high intensity lighting power.

Another object of the present invention is to provide a power supply system for liquid crystal monitors which is particularly efficient and, above all, reliable with respect to the use of a single transformer and which permits to limit at the most the overall dimensions of the wiring harness and to pilot the power drive circuit remotely.

A further object of the invention is to provide a power supply system for liquid crystal monitors with reduced costs relative to conventional systems.

These objects are provided by means of a power supply system for liquid crystal monitors according to claim 1, which is referred to for the sake of brevity.

Further objects and advantages of the present invention will become clear from the following description and from the accompanying schematic drawings, given by way of non limiting example, in which:

BRIEF DESCRIPTION OF THE SEVERAL VIEWS OF THE DRAWINGS

FIG. 1 shows a full-bridge power stage with a push-pull square wave output to be used in a first exemplary limiting embodiment of a power supply system for a plurality of CCFL and/or EEFL fluorescent lamps utilized in liquid crystal monitors with high lighting power.

Such an arrangement permits to pilot a plurality of pairs of piezoelectric transformers PT1, PT2 and PTN, PT2N with the primary windings of the series connected or parallel connected transformers to double the available power and to provide balanced voltage relative to the ground T from the (secondary) side of the fluorescent lamps L1, LN (one lamp for each pair of transformers PT1, PT2; PTN, PT2N) to reduce the brightness variation on the tube of the lamps L1, LN caused by the stray capacities (known as thermometer effect).

The piezoelectric transformers may be Rosen transformers, which are characterized by high voltage gain, with rated load and natural resonance frequency, typical operating frequency of about 50–60 kHz, good conversion efficiency and possibility to pilot the lamps L1, LN directly to the secondary, without using capacitive ballasts, as the lighting of the lamps L1, LN, which requires considerable initial overvoltage, is automatically performed without any frequency or amplitude modulation of the input voltage; in some preferred, non restrictive embodiments of the invention it is possible to use, in particular, the piezoelectric transformers model PGT2526C, manufactured and distributed by Murata.

DETAILED DESCRIPTION OF THE INVENTION

In some preferred, non restrictive embodiments of the invention it is possible to use a piloting apparatus for the PT1, PT2, PTN, PT2N piezoelectric transformers with series-connected inductors LS, since first a convenient measurement of the inductor LS provides ideal switching (soft-switching) and then, as the voltage wave form applied to the transformers PT1, PT2, PTN, PT2N is practically sinusoidal, it is possible to eliminate current peaks and the losses and troubles associated therewith, which would be caused by series-connecting the inductor LS.

The illustrated piloting stage is based on the control of the MOSFET transistors S1, S2, S3, S4, which is provided by simultaneously piloting the pairs on the diagonals of the H-bridge (i.e., according to the sequence S1–S3, S2–S4) and by employing an integrated circuit and a pulse transformer with five windings.

The frequency of the generated square wave is fixed and it corresponds to the frequency which maximizes the output voltage of the piezoelectric transformers PT1, PT2, PTN, PT2N (and, therefore, it corresponds approximately to the resonance frequency); however, since all the parallel-connected transformers PT1, PT2, PTN, PT2N must be fed simultaneously, due to the parameter scattering it is not possible to determine an optimum frequency value for all of them and, therefore, the final embodiment includes a device producing a limited frequency deviation of the square wave to minimize this problem.

The feeding of the H-bridge is dual and is provided by VDC generators in order not to apply continuous voltage components to the transformers PT1, PT2, PTN, PT2N.

Figure 1:
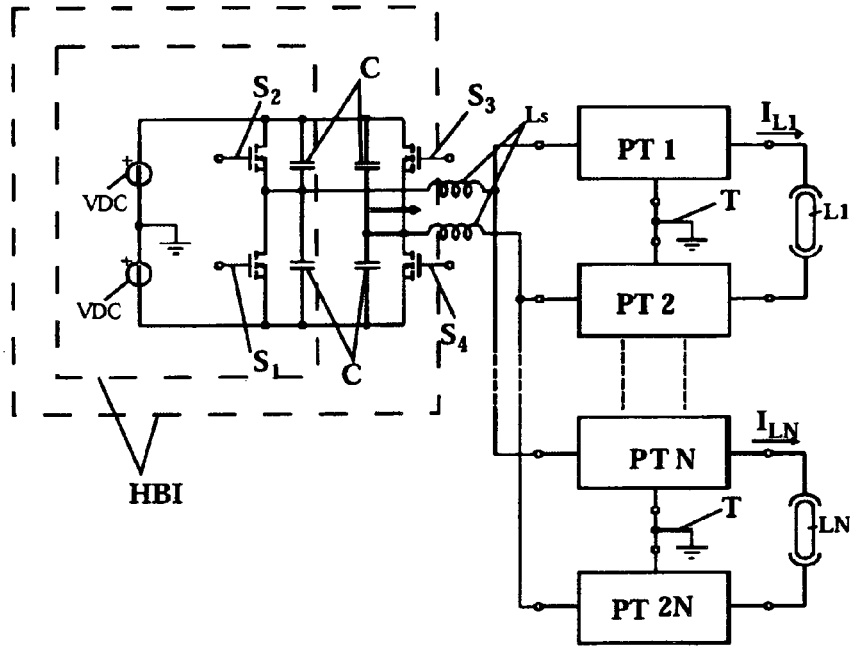
FIG. 1 schematically shows a first embodiment of a pilot circuit for liquid crystal monitors which can be used in the power supply system of the present invention.

Practically, the described feeding system employs two half-bridge inverters, schematically indicated with HBI in FIG. 1, the phases of which are rotated through 180° with respect to each other.

Relative to prior art, such an arrangement has many advantages, including the fact that piezoelectric transformers, which are more commonly and easily available than magnetic transformers (which also have large dimensions and extremely higher costs), have a power dissipation which is lower than 5 Watts and can be used with single-ended outputs.

On the other hand, single-ended piloting does not provide optimum light emission, especially at low current levels, due to the stray capacities C which increase the current provided to the lamp L1, LN, said increase depending on the current length (as a matter of fact, maximum lighting power is achieved adjacent to the high-voltage terminal of the lamp L1, LN, whereas said power decreases adjacent to the terminal connected to the ground T); thus it is natural to take into consideration the use of two piezoelectric transformers PT1, PT2, PTN, PT2N for each lamp L1, LN to pilot each lamp L1, LN symmetrically and to achieve a substantially homogeneous light emission, permitting to pilot high-power lamps L1, LN with the same feeding.

The inductance value of the coupling inductors LS (which depends on the number of piezoelectric transformers in the pilot circuit and, consequently, on the number of piloted fluorescent lamps L1, LN) is optimized on the basis of the input impedance of each transformer PT1, PT2, PTN, PT2N and it provides a positive impedance phase in a sufficiently wide frequency range around the natural resonance frequency of the transformer, so that the switching operations are substantially gradual (soft-switching) at least at the rated value of output power.

Finally, unlike the dimming technique, which is based on the frequency variation and is usually employed in piezoelectric transformers, to maximize both the efficiency and the uniformity of the light emitted by the lamps L1, LN, in this case the operator acts only on the continuous voltage for feeding the H-bridge by means of a presetting stage which also guarantees the correct system operation within the whole feeding range (12–24 Volts with direct current).

Figure 2:
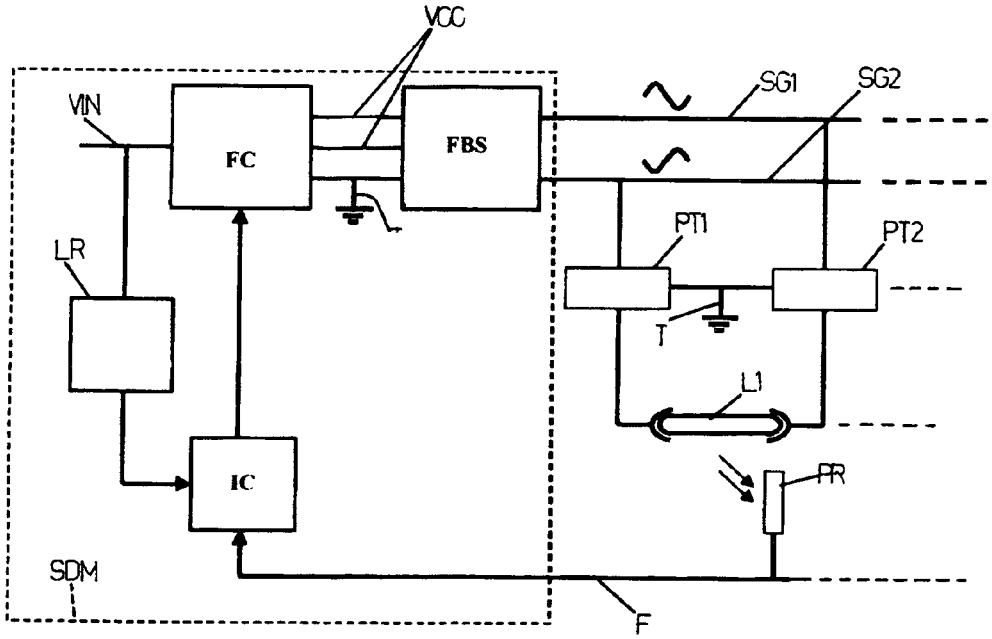
FIG. 2 is a block diagram of the power supply system for liquid crystal monitors based on the pilot circuit of FIG. 1, according to the present invention.

FIG. 2 shows a first block diagram of the power supply system utilizing the pilot circuit of FIG. 1, clearly showing the DC/AC converter stage indicated with FBS and formed by the H-bridge of FIG. 1, the presetting stage FC (DC/DC converter) and a feedback ring F with a controller IC for the dimming function.

Figure 3:
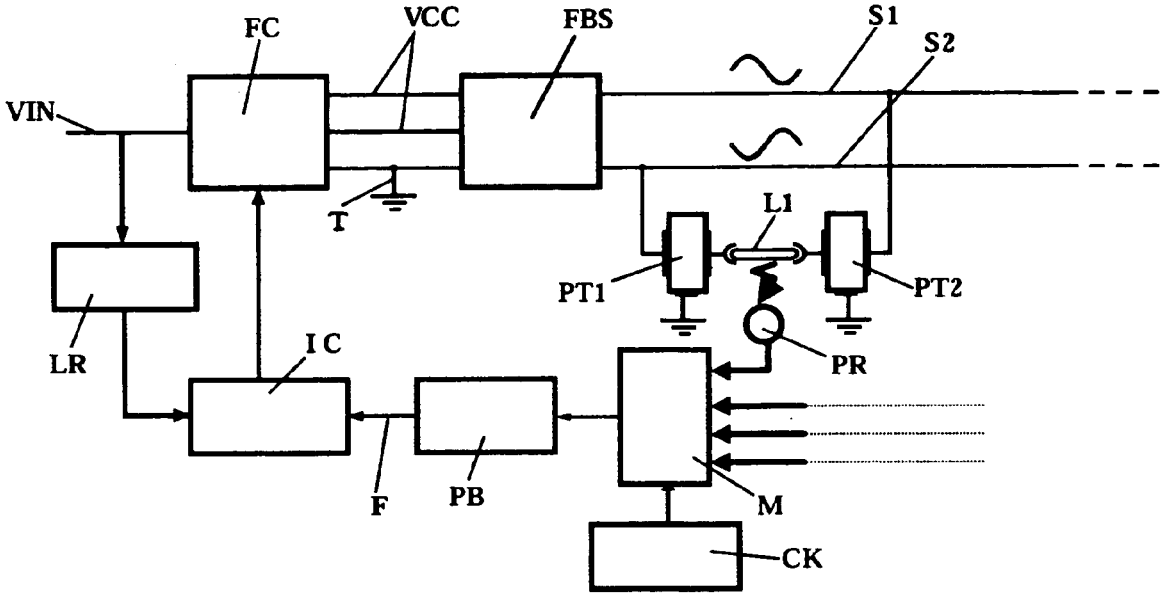
FIG. 3 is an improved block diagram of the power supply system of FIG. 2.

In the diagram of FIG. 2 the brightness control (dimming) is performed indirectly by means of the control module SDM, by feedbacking a signal which is directly proportional to the brightness of the lamps L1, LN, by providing each fluorescent lamp L1, LN with a sensor or photoresistor PR and combining the signals of the sensors PR by means of a controller consisting, for example, of a multiplexer (indicated with M in FIG. 3).

The inverter of the converter FBS can be piloted by a 12 or 24 Volt DC single input feeding voltage (VIN), so that the inverter can continue to work also when one or more lamps L1, LN are damaged, since said inverter permits to pilot the single lamps L1, LN differentially.

Specifically, in FIG. 2 each lamp L1 is piloted differentially by a pair of piezoelectric transformers PT1, PT2 (the pairs of transformers PT1, PT2 are parallel connected with each other) to which two opposite sinusoidal signals SG1, SG2 are sent, said sinusoidal signals being produced by the converter FBS which, in this case, is provided as shown in FIG. 1, i.e. with four diagonally piloted MOSFET devices S1–S4 (full bridge switching converter). This way, the pairs of transformers PT1, PT2 operate independently from each other to light the lamps L1, LN even when one or more of such lamps L1, LN is damaged or malfunctioning.

According to the circuit of FIG. 2, which is optimized for 15 inches (7 lamps) monitors, but can easily be applied to large monitors, the brightness control of the lamps L1, LN is based upon controlling a continuous voltage by means of a flyback CC/CC converter of the presetting stage FC, said converter being voltage controlled at a sampling frequency of 200 kHz, whereas the feedback signal F is naturally optical, since it is drawn from lamp L1, LN to obtain information about the power of the average lighting emitted by the screen (which is the variable to be regulated).

Further, a self-diagnostic system is used which permits to detect the malfunctioning lamps L1, LN of the screen.

The peculiarities of the control system of FIG. 2, shown in more detail in the block diagram of FIG. 3, can be summarized as follows:

- direct control of the screen brightness, independently from other factors, e.g. temperature, aging, etc.;
- sturdiness against the failures of some lamps of the screen (due to the combination of the signals entering the multiplexer M, which is controlled by the clock signal CK);
- possible detection of the failure of one or more lamps, by monitoring the signal F from the multiplexer M, upstream the low-pass filter PB;
- possible acceptance of feeding voltages within a wide range of values (for the presence of the flyback presetting stage FC);

possible limitation of the maximum current in the lamps L1, LN by limiting the output voltage VCC of the flyback presetting stage FC.

From the block diagram of FIG. 3 it can also be seen that the integrated circuits are fed directly by the input voltage VIN by means of a linear voltage stabilizer LR; as a matter of fact, unlike what is usually done, it is not possible to have voltage stabilized by the same flyback presetting stage FC (for example with an auxiliary winding in the transformer), since the output voltage can vary according to the dimming of the lamps L1, LN.

Anyway, the use of the linear regulator LR is acceptable when considering that the power needed to feed only the integrated circuits of the control system SDM is negligible and, therefore, this does not prejudice considerably the overall system efficiency.

In some preferred, non restrictive embodiments of the invention for the H-bridge a common integrated circuit UC3525 can be used, the output drivers of which are also suitable for piloting pulse transformers; the integrated circuit UC3525 also includes an oscillator and the circuits for inserting the dead times on the commands of the MOSFET transistors S1–S4 (FIG. 1), which are essential in any half-bridge and/or full-bridge application.

The frequency of the square wave generated by the H-bridge is normally set around the resonance frequency of the transformers PT1, PT2, PTN, PT2N for maximum efficiency, whereas the inductors LS must be measured once the parameters of the transformers PT1, PT2, PTN, PT2N are known, to provide soft-switching.

Figure 4:
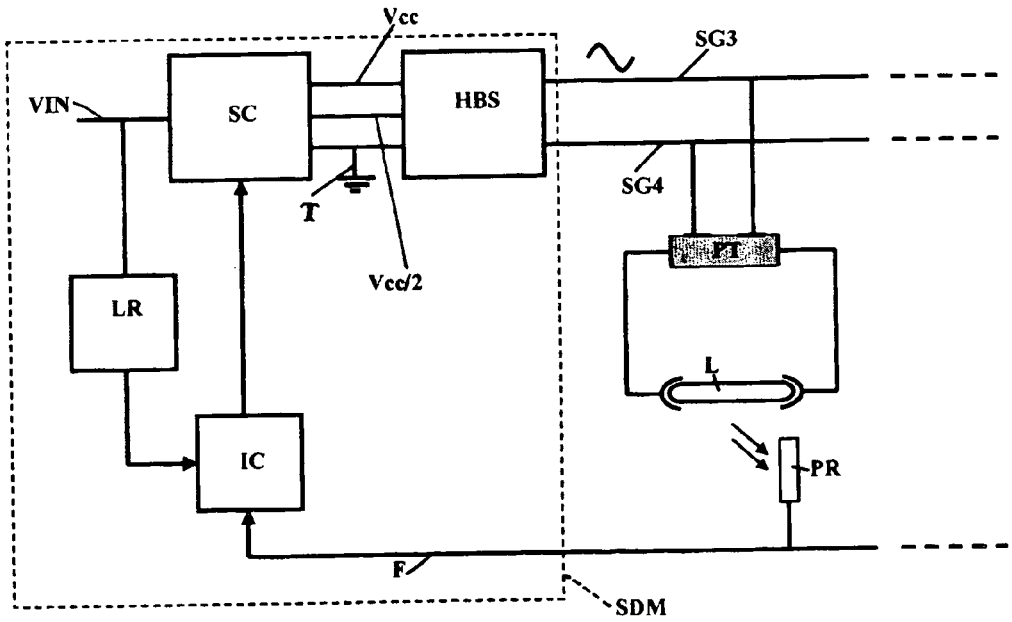
FIG. 4 is a block diagram of another embodiment of the power supply system for liquid crystal monitors based on the pilot circuit of FIG. 2, according to the present invention.

Alternatively, a feeding system can be used, the block diagram of which is illustrated in FIG. 4.

In this case, instead of using two single-ended piezoelectric transformers PT1, PT2, PTN, PT2N for each lamp L1, LN, a single balanced transformer PT is used for each lamp L, by employing, in the regulating block, a half-bridge DC/AC converter (instead of the full-bridge converter FBS), indicated with HBS in FIG. 4, and a SEPIC DC/DC converter, indicated with SC in FIG. 4, which operates within the whole range of 12–24 Volt input voltages, without any particular regulation.

Therefore, each lamp is differentially piloted by a single balanced piezoelectric transformer PT and each piezoelectric transformer PT (all of them being parallel connected with each other) receives at the input a continuous voltage (signal indicated with SG4) which is a half (VCC/2) of the continuous voltage VCC on an input pin, and a single sinusoidal signal (signal indicated with SG3) on the other input pin, said sinusoidal signal being provided by the half-bridge converter HBS (with 2 MOSFET transistors).

Also in this case the feedback control is performed by the photoresistor PR and no ballast capacitive circuit is requested to operate the system, as in prior art feeding systems; moreover, the inverter can receive a 12 or 24 Volt (direct current) input feeding voltage and each piezoelectric transformer PT works independently from the other, in that, when one or more lamps are damaged, all other transformers PT (parallel connected one to each other) continue to work.

This circuit topology is a good compromise between the need to reduce the overall dimensions and to keep the necessary circuit precautions to reduce failures.

From a construction point of view, both in the circuit of FIG. 2 and in the circuit of FIG. 4, all transformers PT and the connectors thereof may be set up on one printed circuit board to be positioned along the monitor side where the lamps L are placed, to reduce the distance between the connectors of the lamps L and the transformers PT (or the pairs of transformers), without using multiple connectors and further wiring harness between one transformer and another (or between one couple of transformers and another) and reducing the stray capacities and, consequently, the power losses caused by high frequencies and voltages.

Brightness is controlled by regulating the dual feeding voltage (+VCC, −VCC) of the full bridge converters FBS (single-ended piezoelectric transformers) or the voltages +VCC, VCC/2 of the half-bridge converters HBS (with balanced piezoelectric transformers); the reliability and efficiency of the circuit are thus optimized in that the transformers PT operate at a predetermined frequency (i.e., the resonance frequency of each transformer) and, therefore, the input voltage of each single transformer (when said voltage can be limited at safety levels) can be controlled accurately.

As shown in detail in the drawings, also in the circuit diagram of FIG. 4 the feedback control is provided through a plurality of photoresistors PR which stabilize the system by measuring the brightness of each lamp L; this feedback loop, which has the brightness of the lamps L as an input signal, provides accurate brightness stability of the monitor, independently of external factors, e.g. temperature variations, lamp aging, etc.; moreover, also in this case a self-diagnostic system can be used to single out the malfunctioning and/or damaged lamps L.

Figure 5:
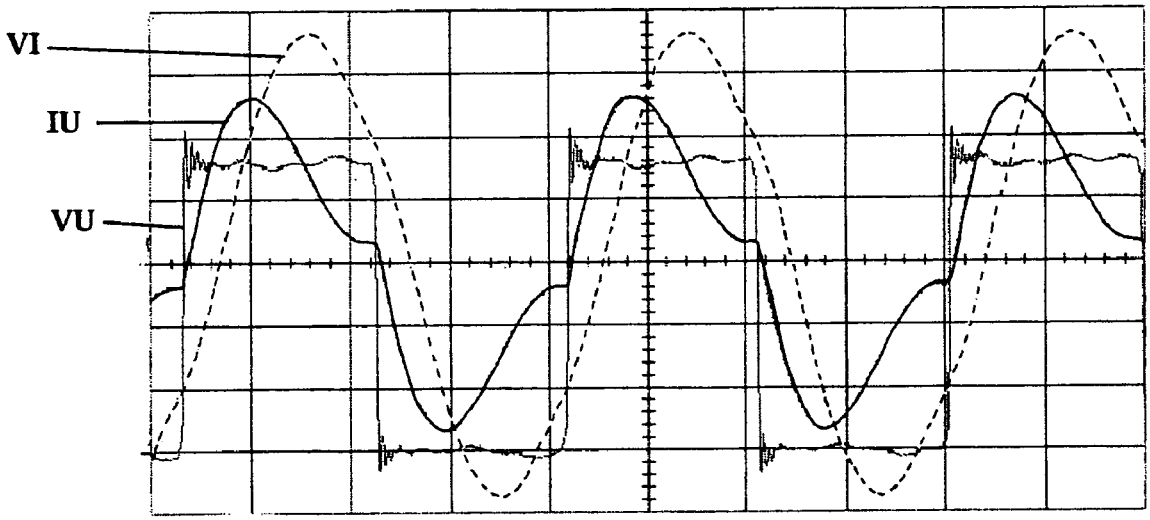
FIG. 5 is a Cartesian graph showing the time variations of some magnitudes relating to the system inverter, said variations being measured on a prototype of the power supply system of FIG. 4, according to the invention.

The time variations of the magnitudes relating to the inverter, illustrated in the diagram of FIG. 5, derive from some measurements carried out on a prototype of the power supply system for a monitor having five lamps L, with design values of the inductors and output voltage of 12 Volts for feeding the full-bridge inverter (circuit of FIG. 2); in particular, FIG. 5 shows the time variations of the output voltage from the inverter, indicated with VU in the diagram, the output current from the inverter, indicated with IU, and the input voltage to the piezoelectric transformers PT, indicated with VI.

The characteristics of the power supply system for liquid crystal monitors of the present invention, as well the advantages thereof, will become apparent from the above description, said characteristics and advantages including in particular:

- reduced overall dimensions of the circuit relative to prior art;
- reduced number of utilized electronic components, thus subsequently increasing the system reliability, safety and quality;
- reduced production and operating costs relative to prior art;
- better efficiency;
- reduced emission of electromagnetic radiations, which are noxious to the user;
- possible feeding of the circuit with direct current voltages from 12 to 24 Volts, without any need to use any kind of regulator;
- elimination of the brightness defects (the brightness intensity typically decays after the first hundreds of working hours on the basis of the working temperature) inherent in the construction of cold cathode fluorescent lamps CCFL and EEFL);
- possibility of piloting the power drive circuit from remotely;
- easy achievement of diagnostic circuits;
- monitor uniform lighting.

Finally, it is clear that several variations can be made to the power supply system of the invention, without thereby departing from the scope of the invention, and that, when practically carrying out the invention, the materials, shapes and dimensions of the illustrated details can vary according to the user's needs and be changed with other technically equivalent ones.

The invention claimed is:

1. A power supply system for liquid crystal monitors, characterized in that it includes at least a first DC/AC converter (FBS, HBS) operating at predetermined frequency and duty-cycles and being fed by at least a second DC/DC converter (FC, SC) which regulates the circuit voltage to feed a plurality of fluorescent lamps (L, L1, LN) in the monitor through a wiring harness which transmits at least an output sinusoidal signal (SG1, SG2, SG3) from said first DC/AC converter (FBS, HBS) to the primary windings of a plurality of parallel connected piezoelectric transformers (PT, PTl, PT2, PTN, PT2N), which are connected with the fluorescent lamps (L, L1, LN,).

2. A power supply system as claimed in claim 1, characterized in that each fluorescent-lamp (L, L1, LN) of the monitor is at least with a piezoelectric transformer (PT1, PT2; PTN, PUN; PT), wherein the primary windings of said transformers (PT1, PT2; PTN, PT2N; PT) are series or parallel connected one with another and are connected with series-connected inductors (LS), or in the alternative.

3. A power supply system as claimed in claim 1, characterized in that said first converter (FBS) includes at least a piloting stage which is based on the control of pairs of MOSFET transistors (S1, S2, S3, S4), on the diagonals of a dually fed H-bridge, through direct current generators (VDC).

4. A power supply system as claimed in claim 1, characterized in that said first converter (FBS) employs two half-bridge inverters (HBI), the phases of which are rotated through 1800 with respect to each other.

5. A power supply system as claimed in claim 1, characterized in that it includes a feedback circuit (F) having a controller (IC) for controlling the brightness emitted by the fluorescent lamps (L, L1, LN), said brightness control being performed by feedbacking a signal which is directly proportional to the brightness of said lamps (L, L1, LN), said signal being provided by at least a sensor (PR) associated with each lamp (L, L1, LN), the signals provided by said sensors (PR) being combined together by means of a controller (M).

6. A power supply system as claimed in claim 2, characterized in that each fluorescent lamp (L1, LN) has a different input current from one another and said current is generated by a pair of piezoelectric transformers (PT1, PT2), said pairs of transformers (PT1, PT2) being parallel connected wit each other.

7. A power supply system as claimed in claim 6, characterized in that said second DC/DC converter (FC) controlling a continuous input voltage (VIN) consists of a flyback converter which is voltage controlled at a predetermined sampling frequency.

* * * * *